United States Patent [19]

Dubois et al.

[11] Patent Number: 4,618,857

[45] Date of Patent: Oct. 21, 1986

[54] LOW D.C. AND LOSS OF A.C. SENSOR AND ALARM WITH SERVICE INHIBITOR

[75] Inventors: Harvey W. Dubois, P.O. Box 9568, New Iberia, La. 70560; Fred Heselton, New Iberia, La.

[73] Assignees: Harvey W. Dubois; R. J. Provost, both of New Iberia, La. ; part interest to each

[21] Appl. No.: 622,560

[22] Filed: Jun. 20, 1984

[51] Int. Cl.[4] ..... G08B 21/00

[52] U.S. Cl. ..... 340/654; 307/66; 340/333; 340/636; 340/663

[58] Field of Search ..... 340/654, 636, 663, 333; 307/64, 65, 66

[56] References Cited

U.S. PATENT DOCUMENTS 3,603,973 9/1971 Hough ..... 340/333 X
4,017,724 4/1977 Finger ..... 340/636 X

*Primary Examiner*—James L. Rowland
*Assistant Examiner*—Daniel Myer
*Attorney, Agent, or Firm*—Bode & Associates

[57] ABSTRACT

A system for monitoring a battery voltage level and A.C. power supply. The A.C. power supply and a backup battery are used to power a voltage regulator which provides a reference voltage to the system. A first comparator circuit senses a drop of the voltage from the monitored battery below a predetermined level and provide a signal in response thereto. A second comparator circuit senses the loss of A.C. power and produces a signal in response thereto. A backup battery provides power to the system in the event of the loss of A.C. power. The signals produced by the comparator circuits activate a timer which in turn activates an alarm to indicate a problem in the system. The timer may be automatically deactivated by a return of the battery voltage level above the predetermined value to prevent false alarms. A second timer is also provided to provide deactivation of the alarm during servicing of the system. The system is designed so that the alarm will be sounded in the event of loss of A.C. power and power from the monitored battery to the system. The backup battery provides the necessary power to the system for sounding the alarm.

11 Claims, 2 Drawing Figures

LOW D.C. AND LOSS OF A.C. SENSOR AND ALARM WITH SERVICE INHIBITOR

BACKGROUND OF THE INVENTION

1. Field of the Invention

This invention relates in general to voltage level detecting circuits, and more particularly, for monitoring the D.C. voltage level in a battery and A.C. power to a charger for maintaining a charge on the battery.

2. General Background

A disadvantage in systems presently in use is that many systems utilize power from the battery being monitored to power the circuitry used as a reference voltage for monitoring the voltage in the battery. This is a disadvantage in that it drains the main battery of useful life and should the main battery fail suddenly, there is no power in the system for activating an alarm. Also, if a system utilizes only A.C. power as a means for providing a reference voltage, the failure of A.C. power leaves the system without backup to provide a reference voltage to the circuitry. Voltage monitoring systems of which applicant is aware include the following.

U.S. Pat. No. 3,969,697, issued to H. Iwasa et al, entitled "Voltage Drop Warning Apparatus with Negative-Resistance Device," teaches battery monitoring circuitry that senses when a battery is failing and activates an alarm. A series connection comprising a transitor and a light emitting diode is connected across a D.C. power source. One end of a negative resistance device is connected to the base of the transistor and the other end is connected to the end of the light emitting diode, which is connected to the D.C. power source. The circuit memorizes an occurrence of voltage drop which enables bi-stable switching in the negative resistance device, thereby energizing the LED. The circuit can be used to indicate voltage lowering or interruption of an A.C. power supply or weakening of a battery.

U.S. Pat. No. 4,017,724, issued to E. P. Finger, entitled "Apparatus For Measuring Battery Depletion By Monitoring Reductions In Voltage", teaches a battery monitoring circuit that senses when a battery is failing and activates an alarm. The apparatus comprises means for sensing reductions in the output terminal voltage of the battery due to varying load conditions and produces a signal in response thereto during the time when the voltage terminal is below a threshold value. The apparatus also comprises an integrater such as an electronic counter or a stepping motor for integrating the signal and means for displaying the integral accumulated.

U.S. Pat. No. 4,119,904, issued to S. A. Haglund, entitled "Low Battery Voltage Detector," discloses a circuit for detecting a low voltage condition and a battery comprising a MOSFET, an inverter, means for connecting the MOSFET to one terminal of the battery, means for connecting the source of the MOSFET to the other terminal of the battery, means for connecting the drain of the MOSFET to one terminal of the battery into the input of the inverter and feedback means for connecting the output of the inverter to the gate of the MOSFET. A predetermined low voltage condition in the battery causing a decrease in voltage at the gate of the MOSFET when this voltage drops below the threshold value of the MOSFET turns the MOSFET off, thus producing an increased voltage at the input of the inverter and a decreased voltage at the output of the inverter which is fedback to further decrease the voltage and cause rapid shutoff of the MOSFET, producing an indication of the low voltage condition in the battery.

U.S. Pat. No. 3,778,800, issued to L. L. Blackwell, et al, entitled "Self-Monitoring Battery Operated Circuit," discloses a time pulse generator connected to a battery being monitored. The output of the time pulse generator drives a signalling device to indicate a low level battery condition and/or an alarm condition as detected by an external sensor.

U.S. Pat. No. 4,224,539, issued to F. H. Musa, et al, entitled "FET Voltage Level Detecting Circuit," discloses a field effect transitor (FET) voltage level detector having a constant voltage reference. The voltage level detector is made as a monolithic integrated circuit and has a constant voltage reference generator having at least three field effect transitors connected in series, wherein the first transitor is a depletion device and the second and third transitors are enhancement devices having their gate electrodes connected to their drain electrodes. An output of the constant voltage reference generator is provided by a junction formed by the transistors. There is also provided a power supply voltage sensor having a plurality of resistances coupled between the terminals of the power supply. The constant voltage reference generator provides a constant voltage which does not vary with variations of the power supply voltage while the power supply voltage sensor varies in relation to the variations of the power supply. Outputs of the constant voltage reference generator and the power supply voltage sensor can be coupled to a comparator so that the comparator will provide an output whenever the voltage sensed by the power supply voltage sensor reaches a predetermined level.

U.S. Pat. Nos. 3,786,342; 4,025,700; 4,138,664; 4,030,086; 4,216,648; and 3,778,800 disclose circuits for monitoring a battery operated circuit, indicating battery discharge or warning devices or multi-voltage step batteries and are representative of what is in the art.

SUMMARY OF THE INVENTION

What is provided is an electronic sensing device used to monitor the D.C. voltage level in a battery and activate an alarm when the D.C. voltage level drops below a predetermined value. The sensor operates off of a separate voltage supply from the battery being monitored to power a comparator circuit which compares the voltage from the monitored battery and the reference power supply. The reference power supply may be a battery or A.C. power. A.C. power is normally used with a backup battery placed on standby at all times in the event of loss of A.C. power. As battery voltage occasionally may vary due to fluctuations below the predetermined value, a delay timer is provided which prevents false audible alarms indicating low battery voltage. The alarm also indicates the loss of A.C. power to the charger which maintains the main battery in a charged state.

In view of the above, it is an object of the present invention to provide a monitoring circuit which draws low current from the battery being monitored.

It is another object of the present invention to provide an alarm should the battery voltage drop below a predetermined value.

It is a further object of the present invention to provide a monitoring circuit which utilizes a backup power supply.

It is yet another object of the present invention to provide a monitoring circuit which may be serviced without activating the alarm.

In view of the above, it is a feature of the present invention to provide a monitoring circuit with comparator circuit means.

It is another feature of the present invention to provide a monitoring circuit with an audible alarm.

It is yet another feature of the present invention to provide a monitoring circuit which operates mainly on A.C. power and has a backup battery power supply.

It is a further feature of the present invention to provide a service inhibitor switch which temporarily deactivates the alarm.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE INVENTION

Figure 1:
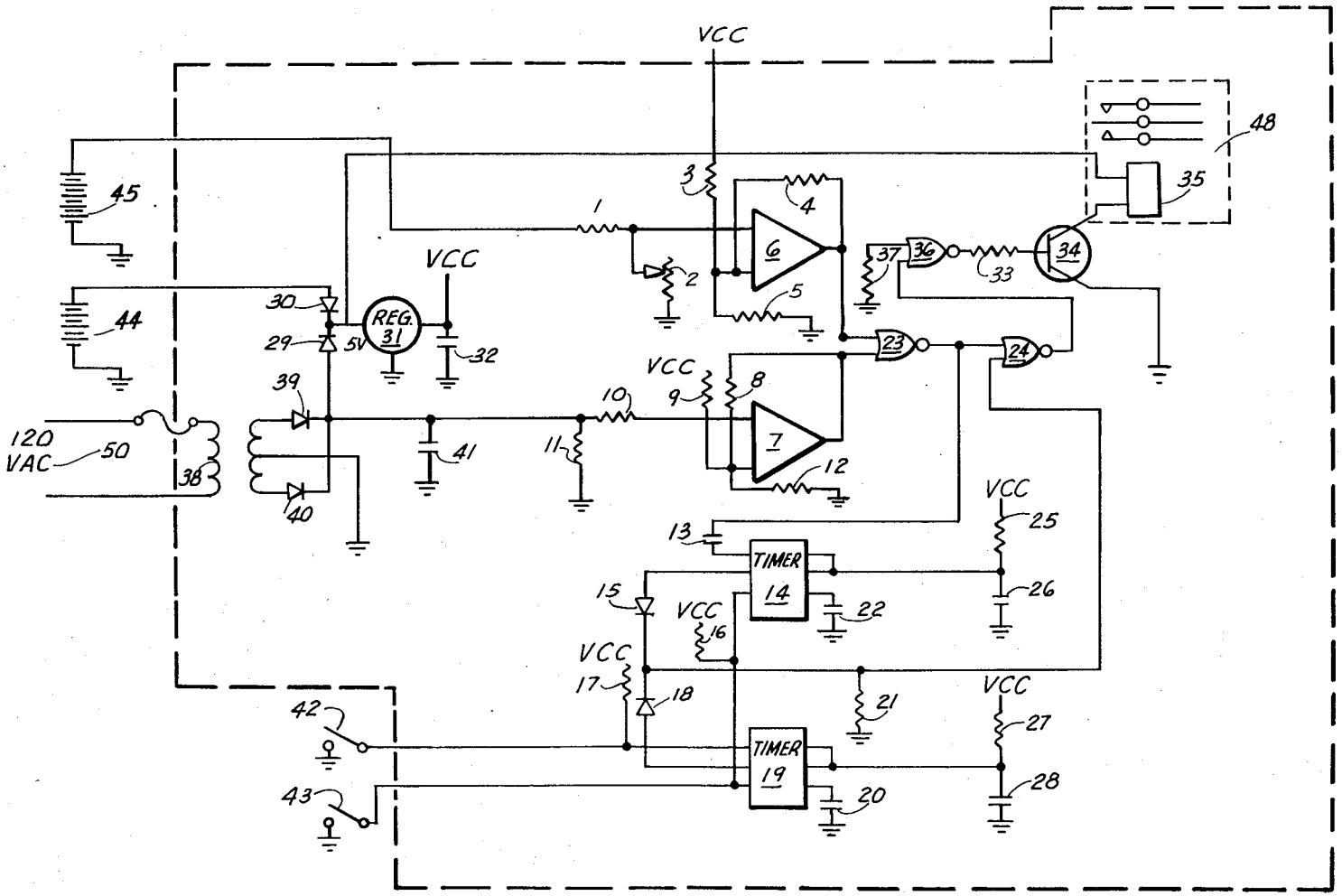
FIG. 1 is a schematic of the sensor circuitry.
Figure 2:
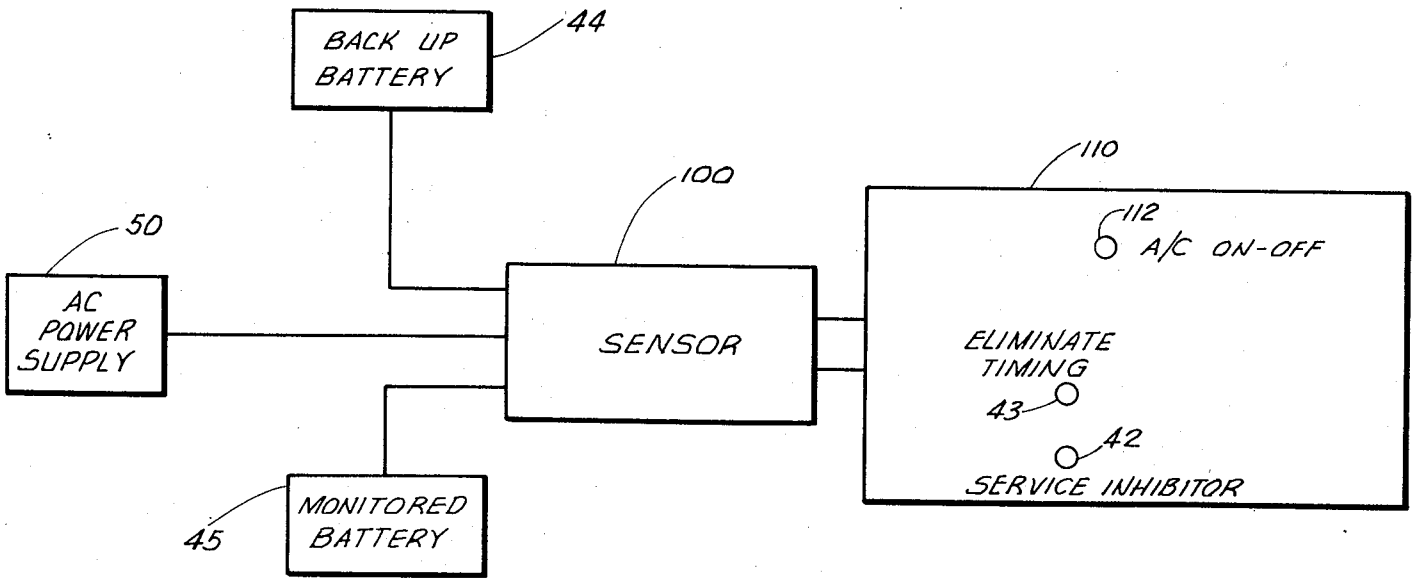
FIG. 2 is a block diagram of the sensor circuitry and the operating panel in connection therewith.

Referring now to the drawings, FIG. 1 is a schematic of the component parts of sensor 100 illustrated in block diagram in FIG. 2. In order to enable a better understanding of the circuit operation, to be further described at a later point, the components of sensor 100 will be first described.

Resistors 1 and 2 are voltage dividers which operate to lower the voltage from battery 45 to a level acceptable to voltage comparator 6. In the preferred embodiment, the circuitry is connected to battery 45, which is a 24-volt battery used to power a variety of electrical components. Resistors 3 and 5 are voltage dividers which provide a reference voltage for comparison to the battery voltage. Resistor 2 is a variable resistor and provides a means of fine tuning the voltage relationship between the battery and the reference voltage. Resistor 4 prevents comparator 6 from oscillating by providing hysterisis. Resistor 10 is an input limiting resistor for comparator 7; resistor 11 is a capacitor discharge resistor for capacitor 41; when A.C. power from source 50 fails, capacitor 41 stays charged and resistor 11 discharges capacitor 41 to initiate the power fail alarm 48. Diode 29 blocks the battery voltage from going to comparator 7. This diode allows the A.C. supply voltage to go to regulator 31. Regulator 31 is the power supply for all the voltage dividers with VCC voltage sources; however, the votage divider formed by resistors 1 and 2 is from a separate supply, external battery 45, whose voltage is being sensed. Resistors 9 and 12 form a voltage divider providing a reference voltage for comparison with the monitored power supply voltage. Resistor 8 prevents the comparator 7 from oscillating the same as comparator 6. (Thus there is a 5-volt power source for the voltage source VCC for the voltage dividers formed by the resistors 3, 5 and 9, 12; battery 45 is the power source for the voltage divider formed by resistors 1 and 2—it is not VCC.) NOR gate 23 couples the outputs from comparators 6 and 7 together in a manner such that each output does not influence the other. Capacitor 13 couples pulses from NOR gate 23 to timer 14. Diodes 15 and 18 serve to block the output from timers 14 and 19, thereby preventing interference of the output of timers 14 and 19 with each other. Resistor 16 prevents falsing (the improper operation due to stray electrical impulses from anywhere internal or external to sensor 100) of the re-set input to timers 14 and 19. Resistor 17 prevents falsing of the trigger input to timer 19. Capacitor 20 prevents oscillation of timer 19 and capacitor 22 prevents oscillation of timer 14. (Thus diodes 15, 18 prevent output times 14, 19 from interferring with each other; resistors 16, 17 prevent falsing of the reset inputs to timers 14, 19; and capacitors 20, 22 prevent oscillation of timers 14, 19.) Resistor 27 and capacitor 28 operate together to provide a time constant for timer 19. (Timers without capacitors will turn themselves off and on rapidly.) Resistor 25 and capacitor 26 operate together to provide a time constant for timer 14. Resistor 21 prevents falsing of the input to NOR gate 24. NOR gate 24 couples the output from NOR gate 23 and timers 14 and 19 together in a manner so that different outputs do not influence each other. Resistor 37 holds one input to NOR gate 36 at ground potential. NOR gate 36 couples the output of NOR gate 24 and ground together in a manner so that they are not influenced by each other. Resistor 33 limits the current to transitor 34 from NOR gate 36. Relay 35 is a contact (Form C) which is a single pole, double throw contact. D.C. blocking diode 29 is in connection with A.C. power supply 50 and D.C. blocking diode 30 is in connection with backup battery 44. Regulator 31 provides a regulated +5 volt output with an input voltage of greater than 7 volts. Capacitor 32 provides a filtering of the power bus. Battery 44 provides backup power to the reference circuitry in the event of failure of A.C. power 50.

In next describing the circuit operation of sensor 100, the following standards for circuitry operation should be noted. The circuit for comparative analysis and alarm activation normally operates on 120 volt A.C. current. In describing signals as high or low, a high signal is greater than 3.5 volts D.C. and a low signal is less than 0.75 volts D.C. Also, the initials VCC equal 5 volts D.C.

Power for operation of the comparator circuitry and alarm is provided by 120 volt A.C. current 50 or backup battery 44 in the event of failure of A.C. current 50. The 120 volts from A.C. current 50 is lowered to 9 volts A.C. by transformer 38, rectified by diodes 39 and 40, and filtered by capacitor 41 into 9 volts D.C. The negative side of this 9 volt D.C. goes to circuit ground. The positive side of the 9 volts D.C. goes to the anode of blocking diode 29. In the event that A.C. current 50 fails, 9 volt battery 44, having its negative terminal connected to a ground and its positive terminal connected to the anode of diode 30, takes over as power source for the comparator circuitry and alarm. The cathodes of diodes 29 and 30 are connected to the input of voltage regulator 31. The power to voltage regulator 31 is received from whichever source, diode 29 or 30, has the higher potential. When normal A.C. current 50 is operative, A.C. current 50 is provided to the comparator circuitry by regulator 31 as A.C. current 50 naturally has the higher potential over 9 volt battery 44. In the event that A.C. current 50 should fail, 9 volt battery 44 would have the higher potential and voltage regulator 31 would provide current from backup battery 44 through the comparator circuitry as a reference voltage. Regulator 31 provides a steady 5 volt D.C. output as a result of any input between 7 volt D.C. and 35 volts D.C. This is filtered for the removal of any transients by capacitor 32.

Battery 45, the battery being monitored by sensor 100, is connected with its negative to ground and its positive terminal to the voltage divider resistors 1 and 2. Comparator 6 is constructed so that if the battery input voltage from resistors 1 and 2 is higher than the reference voltage 3 and 5, the output will be low. If the inputs are reversed, the output will be high (alarm). Resistor 2 is variable to allow for precise adjustment of the point at which comparator 6 converts into the alarm state. The power to the circuit also goes to the voltage divider resistors 10 and 11. As long as there is A.C. power to the circuitry, the input to comparator 7 from voltage divider resistors 10 and 11 will be higher than that from reference voltage resistors 9 and 12. This results in the output from comparator 7 being low under normal conditions and high when A.C. power 50 has failed. As stated earlier, resistors 3 and 5 provide a reference voltage for comparision to the monitored battery 45 voltage with comparator 6 and resistors 9 and 12 provide a reference voltage for comparison with A.C. power supply voltage 50 with comparator 7.

The output of comparators 6 and 7 are then fed into the input of NOR gate 23. NOR gate 23 is constructed to receive the outputs of comparators 6 and 7 in such a manner that the separate outputs do not influence each other. NOR gate 23 is constructed so that if both inputs from comparators 6 and 7 are low then the output from NOR gate 23 will be high. However, if either or both inputs from comparators 6 and 7 go high, then the output from NOR gate 23 will go low. Thus, it can be seen that if either comparator 6 or 7 goes into an alarm condition or high output, then NOR gate 23 will be caused to have a low output. This low output from NOR gate 23 is directed to capacitor 13. This causes a pulse to be generated from capacitor 13 which is forwarded to timer 14. This pulse from capacitor 13 to timer 14 initiates a timing cycle in timer 14, the length of which is determined by the time constant of resistor 25 and capacitor 26 as mentioned earlier.

During the timing cycle of timer 14, the output from timer 14 is driven high which goes through diode 15 to an input of NOR gate 24. The timing cycle of timer 19 is initiated by switch 42 and the length of the timing cycle is determined by the time constant of resistor 27 and capacitor 28. The output of timer 19 then is directed through diode 18, is combined with the output from timer 14 and the combined output from timers 14 and 19 is then directed to the input of NOR gate 24. The output of timers 14 and 19 and diodes 15 and 18 are switched such that if the output from either timer 14 or 19 should go high then the input of NOR gate 24 would go high. NOR gate 24 combines the input from NOR gate 23 and timers 14 and 19 into an output from NOR gate 24 according to the following table:

| | | | |
|---|---|---|---|
| | NOR GATE LOW (ALARM) | 23 | OUTPUT HIGH (NORMAL) |
| TIMER OUTPUTS BOTH LOW (NORMAL) | NOR GATE HIGH (ALARM) | 24 | OUTPUT LOW (NORMAL) |
| TIMER OUTPUTS EITHER HIGH (TIMING) | NOR GATE LOW | 24 INHIBITED | OUTPUT LOW |

The timing cycle of timer 19 is initiated by momentary closing of switch 42. Both timers 14 and 19 may have their timing cycles cancelled by a momentary closing of switch 43.

The output of NOR gate 24 is directed to the input of NOR gate 36 and to the base of transistor 47 through resistor 46. If the output of NOR gate 24 is low (normal) then the base of transistor 47 is low (normal) and the transistor 47 is turned off. If the output of NOR gate 24 is high (alarm) then the base of trasistor 47 is high (alarm) and the transistor 47 is turned on (alarm). This will provide a ground to audible alarm 48 and cause audible alarm 48 to activate (thereby emitting an audible sound). The second input of NOR gate 36 is held low by resistor 37. With one input tied low, NOR gate 36 acts as an inverter. If the input from NOR gate 24 to NOR gate 36 is low (normal) then the output from NOR gate 36 is high (normal). If the input from NOR gate 24 into NOR gate 36 is high (alarm) then the output from NOR gate 36 will be low (alarm). The output from NOR gate 36 is directed to the base of transistor 34 through resistor 33. If the base of transitor 34 is high (normal) then transitor 34 will be turned on, thus providing a ground to relay 35 and energizing relay 35 (normal). If the base of transitor 34 is low (alarm) then transitor 34 will be turned off and relay 35 will be deenergized, causing an alarm condition. Relay 35 is provided with form C contacts, single pole double throw, so that the alarm output is operable through normally opened or normally closed contacts.

Referring now to the block diagram of FIG. 2, it can been seen that backup battery 44, monitored battery 45 and A.C. power supply 50 all lead into sensor 100. Sensor 100 is directly connected to control panel 110. Provided on control panel 110 is A.C. switch 112 for turning A.C. power 50 on or off. Eliminate timing switch 43 is provided to control the timing delay of alarm 48 deactivation in conjunction with service inhibitor switch 42. Service inhibitor switch 42 is utilized to deactivate the alarm 48 when service is required to the system such as monitored battery 45. However, service inhibitor switch 42 does not completely disable the alarm 48 but only provides a time delay to deactivate the alarm 48. This prevents accidental permanent deactivation of the audible alarm 48 after servicing has been completed on the unit. This special time delay is important as it would serve to notify any repair personnel that an alarm condition still existed such as monitored battery 45 not being properly wired to sensor 100.

In operation, sensor 100 and control panel 110 would be connected between monitored battery 45 and an electrical device not shown powered by monitored battery 45. The electrical device for example, would normally be one powered by a 24 volt battery and which would require a steady high voltage from the battery in order to be efficient. Sensor 100 provides circuitry as illustrated to sense, by comparators with a reference current, whether monitored battery 45 remains in the proper state of charge during the powering of the electrical device. Three integrated circuits in sensor 100 comprised of comparators 6 and 7, timers 14 and 19 and NOR gates 23 and 24 serve to monitor the voltage from monitored battery 45 and compare this voltage with a reference voltage provided by A.C. power 50 or a backup battery 44. Upon a drop in D.C. voltage from battery 45 below a predetermined level, timer 14 is initiated into its timing phase with resultant change of electrical signals through the circuitry to NOR gates 24 and 36. Timer 14 provides a 30 second delay between the initiation of the timing phase and activation of an audible alarm indicating a low battery condition to prevent prevent false alarms. This 30 second timing delay is provided as current fluctuations below available battery power normally occur. The use of backup battery 44 serves two purposes. First, the use of backup battery 44 prevents any drain on monitored battery 45 for the provision of a reference voltage and secondly, provides for power to activate the audible alarm should A.C. power 50 be lost or a combination of A.C. power 50 and monitored battery 45 be lost. This results in a current drain on the sensed battery of less than 25 micro-amps since very little current is required by sensor 100 to monitor the condition of battery 45. A.C. power 50 may also be connected to battery 45 through a charger to maintain battery 45 in a charged state. The initiation of an alarm 48 upon loss of A.C. power 50 will also provide advance warning of a potential low voltage in battery 45. When service to the system is necessary, such as replacement of battery 45, the audible alarm 48 may be temporarily inactivated by utilizing service inhibitor switch 42. Service inhibitor switch 42 initiates timer 19 into its timing phase with the resultant change in electrical signals through the circuitry to NOR gates 24 and 36. Timer 19 provides (typically) a preferably five (5) minute delay between the initiation of the timing phase and activation of audible alarm 48 indicating a low battery condition or loss of A.C. (one must visually check which condition exists as either is critical). Use of service inhibitor switch 42 does not permanently deactivate the audible alarm 48 but only does so on a time delay basis as it cannot set length of time, only stop timing and immediately go to the alarm state with switch 43. The lenth of the time delay is predetermined, but the alarm can be reactivated by use of the eliminate time switch 114 on control panel 110. This time delay deactivation of the audible alarm prevents accidental permanent deactivation of the alarm should monitored battery 45 not be rewired to the sensor. Should this condition occur, upon the time delay expiring, the audible alarm will be reactivated thus indicating a malfunction or problem in the system. Said circuitry is so designed that the alarm output is in the form of a normally energized relay 35. Under "normal conditions" in the alarm state relay 35 is de-energized. Thus, if the A.C. power 50 and the back-up battery 44 fail, relay 35 will drop out and go to the alarm state.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A system for monitoring the terminal voltage of a first battery and the loss of A.C. power to said system, comprising:

a. A.C. power means connected to said system;

b. means powered by said A.C. power means for providing a reference voltage to said system;

c. a second battery for powering said means for providing said reference voltage in the event said A.C. power means fails;

d. comparator means for sensing the failure of said A.C. power means and/or the drop of said terminal voltage of said first battery below a predetermined value and producing an output signal in response thereto;

e. a timer coupled to said comparator means and having a timing cycle activated by receipt of said output signal; and f. alarm means coupled to said timer and activated by said timer only at the end of said timing cycle, for indicating said voltage drop below a predetermined value and/or failure of said A.C. power means.

2. The system of claim 1, wherein said comparator means further comprises:

a. first comparator means for comparing the output terminal voltage of said first battery with said reference voltage and producing a first output signal when said terminal voltage drops below a predetermined value; and b. second comparator means for comparing said reference voltage with said A.C. power means and producing a second output signal in the event said A.C. power means fails.

3. The system of claim 1, wherein said means for providing a reference voltage comprises a voltage regulator.

4. The system of claim 1, further comprising means for deactivation of said timing cycle in the event said terminal voltage rises above said predetermined value.

5. The system of claim 1, further comprising means to deactivate said alarm for servicing of said system.

6. A system for monitoring the terminal voltage of a first battery and the loss of A.C. power to said system, comprising:

a. A.C. power means connected to said system;

b. means powered by said A.C. power means for providing a reference voltage to said system;

c. a second battery for powering said means for providing said reference voltage in the event said A.C. power means fails;

d. a first comparator circuit for comparing the output terminal voltage of said first battery with said reference voltage and producing a first output signal when said terminal voltage drops below a predetermined value;

e. a second comparator circuit for comparing said reference voltage with current from said A.C. power means and producing a second output signal in the event said A.C. power means fails;

f. a timer coupled to said first and second comparator circuits and having a timing cycle activated by receipt of said first and/or second output signals; and g. alarm means coupled to said timer and activated by said timer only at the end of said timing cycle, for indicating said voltage drop below a predetermined value and/or failure of said A.C. power means.

7. The system of claim 6, wherein said A.C. power comprises 120 volts A.C.

8. The system of claim 6, further comprising means for transforming and reducing said A.C. power to 9 volts D.C.

9. The system of claim 6, wherein said means for providing a reference voltage comprises a voltage regulator for supplying a 5 volt D.C. reference voltage.

10. The system of claim 6, further comprising means to deactivate said timer for preventing a false alarm, upon return of said monitored terminal output voltage above said predetermined value.

11. The system of claim 6, further comprising a second timer for deactivation of said alarm means during servicing of said system.

* * * * *